US009360819B2

(12) United States Patent
Sugiyama et al.

(10) Patent No.: US 9,360,819 B2
(45) Date of Patent: Jun. 7, 2016

(54) PRINTING APPARATUS AND CONTROL METHOD

(71) Applicant: CANON KABUSHIKI KAISHA, Tokyo (JP)

(72) Inventors: Noriyuki Sugiyama, Kawasaki (JP); Yasuyuki Asai, Tokyo (JP); Syunichi Kunihiro, Kawasaki (JP); Naoki Aoyama, Tokyo (JP); Toshiyuki Kuroda, Yokohama (JP); Yoshiaki Suzuki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/719,156

(22) Filed: May 21, 2015

(65) Prior Publication Data

US 2015/0355592 A1 Dec. 10, 2015

(30) Foreign Application Priority Data

Jun. 4, 2014 (JP) ..... 2014-116206

(51) Int. Cl.
*B65H 29/66* (2006.01)
*G03G 15/00* (2006.01)
*B65H 5/24* (2006.01)

(52) U.S. Cl.
CPC ..... *G03G 15/6567* (2013.01); *B65H 29/6609* (2013.01); *B65H 5/24* (2013.01); *B65H 29/6627* (2013.01)

(58) Field of Classification Search
CPC ..... B65H 5/24; B65H 29/6627; B65H 9/008; B65H 9/006; B65H 9/004; B65H 29/6609; B41J 13/26; B41J 13/0018; B41J 29/38
See application file for complete search history.

(56) References Cited

U.S. PATENT DOCUMENTS 6,629,795 B2 * 10/2003 Kinoshita ..... B41J 11/008 271/3.17
7,068,969 B2 * 6/2006 Ueda ..... B65H 3/06 271/10.02
2004/0051237 A1 * 3/2004 Terao ..... B41J 13/0018 271/264

FOREIGN PATENT DOCUMENTS

JP 2000-15881 A 1/2000

* cited by examiner

*Primary Examiner* — Laura Martin
*Assistant Examiner* — John M Royston
(74) *Attorney, Agent, or Firm* — Fitzpatrick, Cella, Harper & Scinto

(57) ABSTRACT

A printing apparatus according to the present invention includes a feeding unit, a conveying unit including a pair of rollers, a printing unit, a control unit and a determination unit. The control can execute successive overlapped conveyance and skew correction. In the skew correction a leading edge of the printing medium abuts against the pair of rollers in a stop state. The determination unit determines whether to execute the successive overlapped conveyance. The control unit executes the skew correction of the succeeding printing medium at a timing according to a determination result of the determination unit.

22 Claims, 13 Drawing Sheets

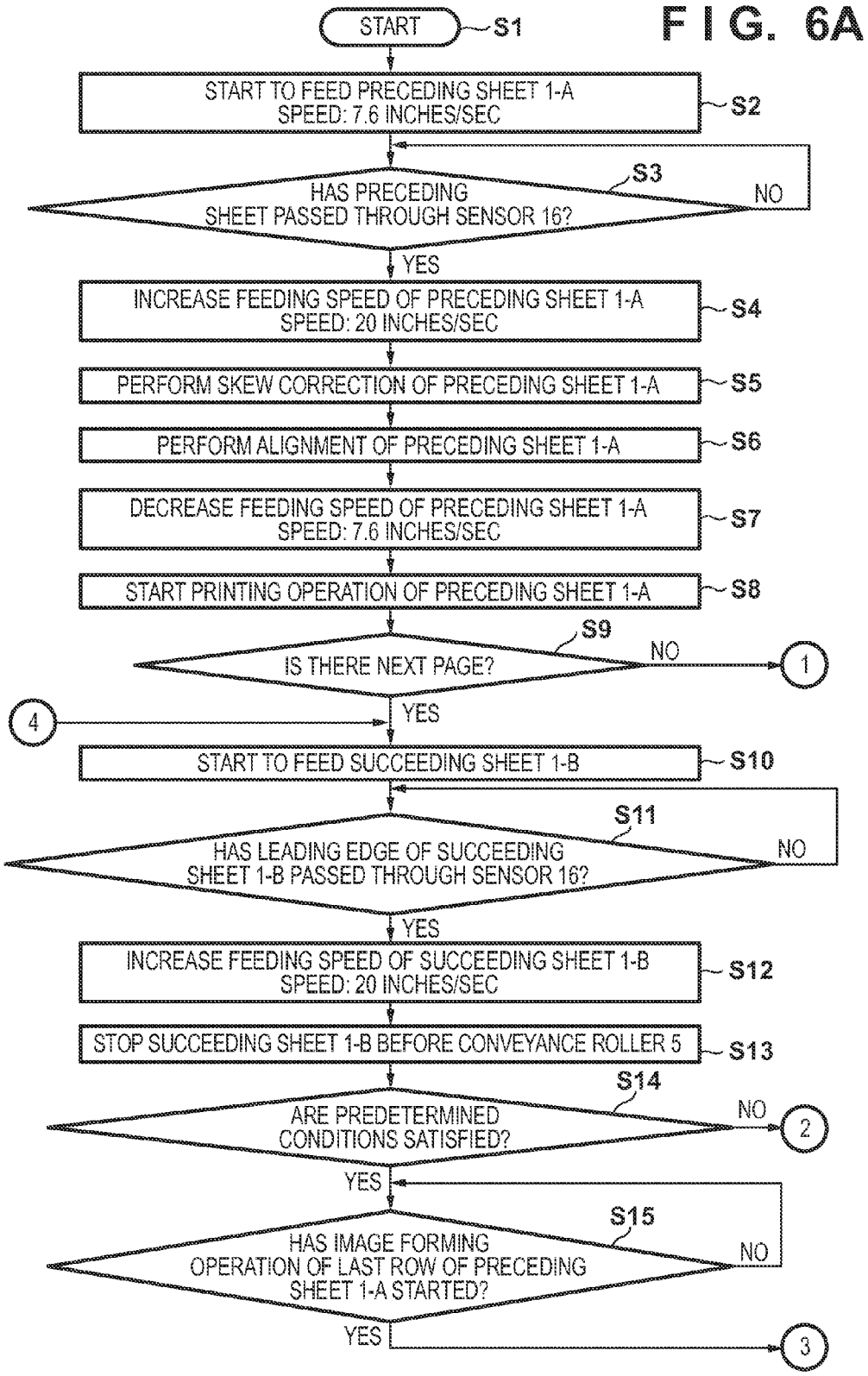
FIG. 6A
START
S1
START TO FEED PRECEDING SHEET 1-A
SPEED: 7.6 INCHES/SEC
S2
HAS PRECEDING
SHEET PASSED THROUGH SENSOR 16?
S3
NO
YES
INCREASE FEEDING SPEED OF PRECEDING SHEET 1-A
SPEED: 20 INCHES/SEC
S4
PERFORM SKEW CORRECTION OF PRECEDING SHEET 1-A
S5
PERFORM ALIGNMENT OF PRECEDING SHEET 1-A
S6
DECREASE FEEDING SPEED OF PRECEDING SHEET 1-A
SPEED: 7.6 INCHES/SEC
S7
START PRINTING OPERATION OF PRECEDING SHEET 1-A
S8
IS THERE NEXT PAGE?
S9
NO
1
YES
4
START TO FEED SUCCEEDING SHEET 1-B
S10
HAS LEADING EDGE OF SUCCEEDING
SHEET 1-B PASSED THROUGH SENSOR 16?
S11
NO
YES
INCREASE FEEDING SPEED OF SUCCEEDING SHEET 1-B
SPEED: 20 INCHES/SEC
S12
STOP SUCCEEDING SHEET 1-B BEFORE CONVEYANCE ROLLER 5
S13
ARE PREDETERMINED
CONDITIONS SATISFIED?
S14
NO
2
YES
HAS IMAGE FORMING
OPERATION OF LAST ROW OF PRECEDING
SHEET 1-A STARTED?
S15
NO
YES
3

PRINTING APPARATUS AND CONTROL METHOD

BACKGROUND OF THE INVENTION

1. Field of the Invention

The present invention relates to a printing apparatus.

2. Description of the Related Art

As a method of increasing the printing speed of a printing apparatus, successive overlapped conveyance of printing media has been proposed. Successive overlapped conveyance indicates a conveyance method of conveying a plurality of printing media while the leading edge of the succeeding printing medium overlaps the trailing edge of the preceding printing medium when images are successively printed on the printing media (for example, Japanese Patent Laid-Open No. 2000-15881). Successive overlapped conveyance makes it possible to further increase the printing speed, as compared with a conveyance method of starting to feed the succeeding printing medium after the end of printing of the preceding medium or a conveyance method of successively conveying the printing media while decreasing the gap between the printing media.

On the other hand, if a printing medium is conveyed while being skewed, an image printing position may deviate. To prevent this, there is known a technique of performing skew correction to correct the skew of the printing medium by making its leading edge abut against a pair of rollers.

Even if images are continuously printed on a plurality of printing media, it may be impossible to perform successive overlapped conveyance depending on the printing conditions of a preceding printing medium and succeeding printing medium. On the other hand, if skew correction is performed, the leading edge of a printing medium abuts against the pair of rollers. After that, therefore, when the pair of rollers is driven, the printing medium having undergone skew correction is conveyed. Depending on the position of the preceding printing medium when performing skew correction of the succeeding printing medium, unintended successive overlapped conveyance may be performed, or no intended successive overlapped conveyance may be performed.

SUMMARY OF THE INVENTION

The present invention provides a technique of executing successive overlapped conveyance and skew correction in synchronism with each other.

According to an aspect of the present invention, there is provided a printing apparatus comprising: a feeding unit configured to feed a printing medium stacked on a stacking unit; a conveying unit configured to convey the printing medium fed by the feeding unit, the conveying unit including a pair of rollers configured to nip the printing medium; a printing unit configured to print on the printing medium conveyed by the conveying unit; and a control unit configured to execute successive overlapped conveyance so that a trailing edge of a preceding printing medium and a leading edge of a succeeding printing medium overlap each other and configured to execute skew correction in which a leading edge of the printing medium abuts against the pair of rollers in a stop state, and a determination unit configured to determine whether to execute the successive overlapped conveyance; wherein the control unit executes the skew correction of the succeeding printing medium at a timing according to a determination result of the determination unit.

Further features of the present invention will become apparent from the following description of exemplary embodiments (with reference to the attached drawings).

BRIEF DESCRIPTION OF THE DRAWINGS

FIGS. 6A and 6B are flowcharts illustrating an example of processing executed by the control unit of the printing apparatus shown in FIG. 1;

DESCRIPTION OF THE EMBODIMENTS

<First Embodiment>

Figure 1:
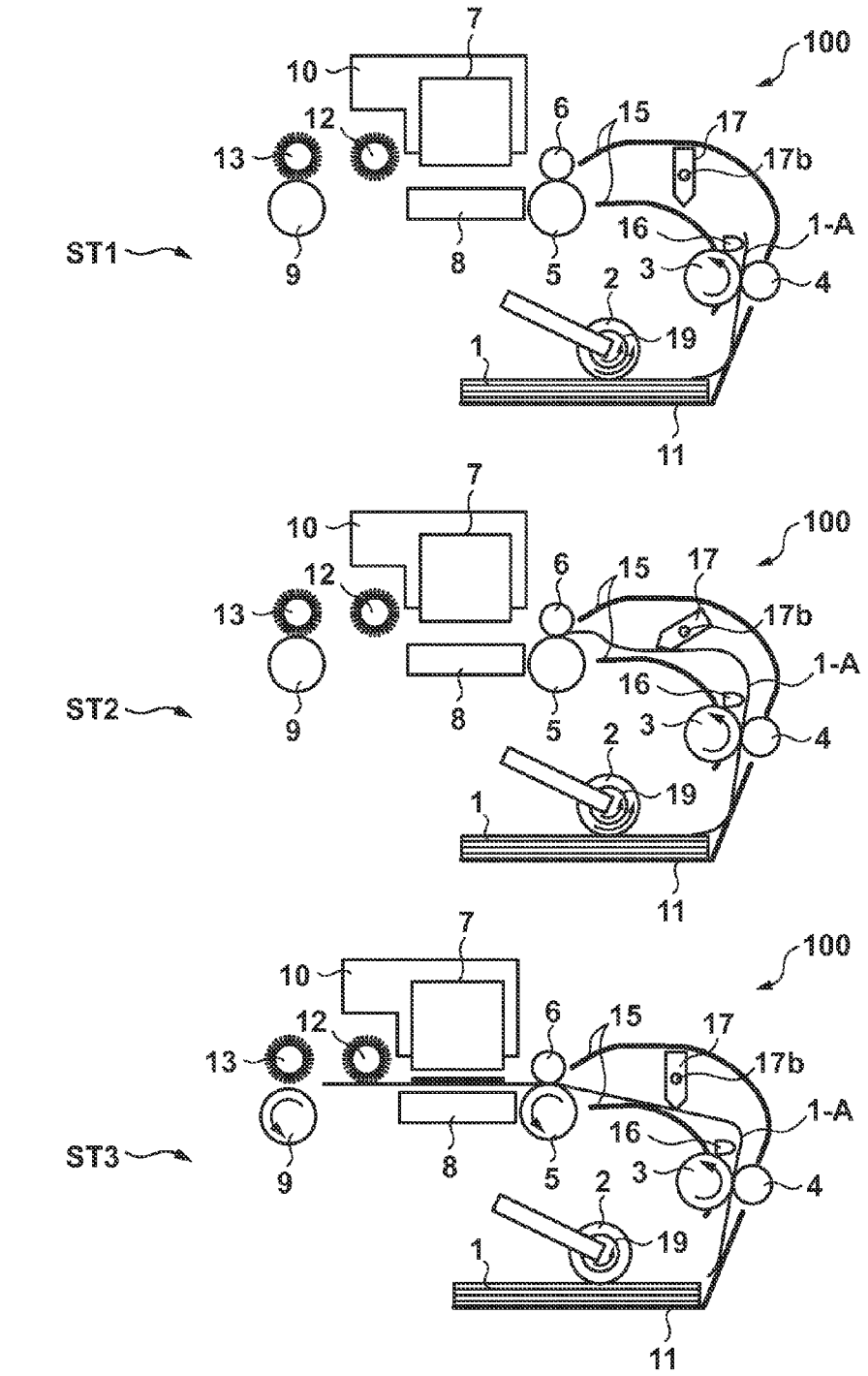
FIG. 1 is a view for explaining the operation of a printing apparatus according to an embodiment of the present invention.
Figure 2:
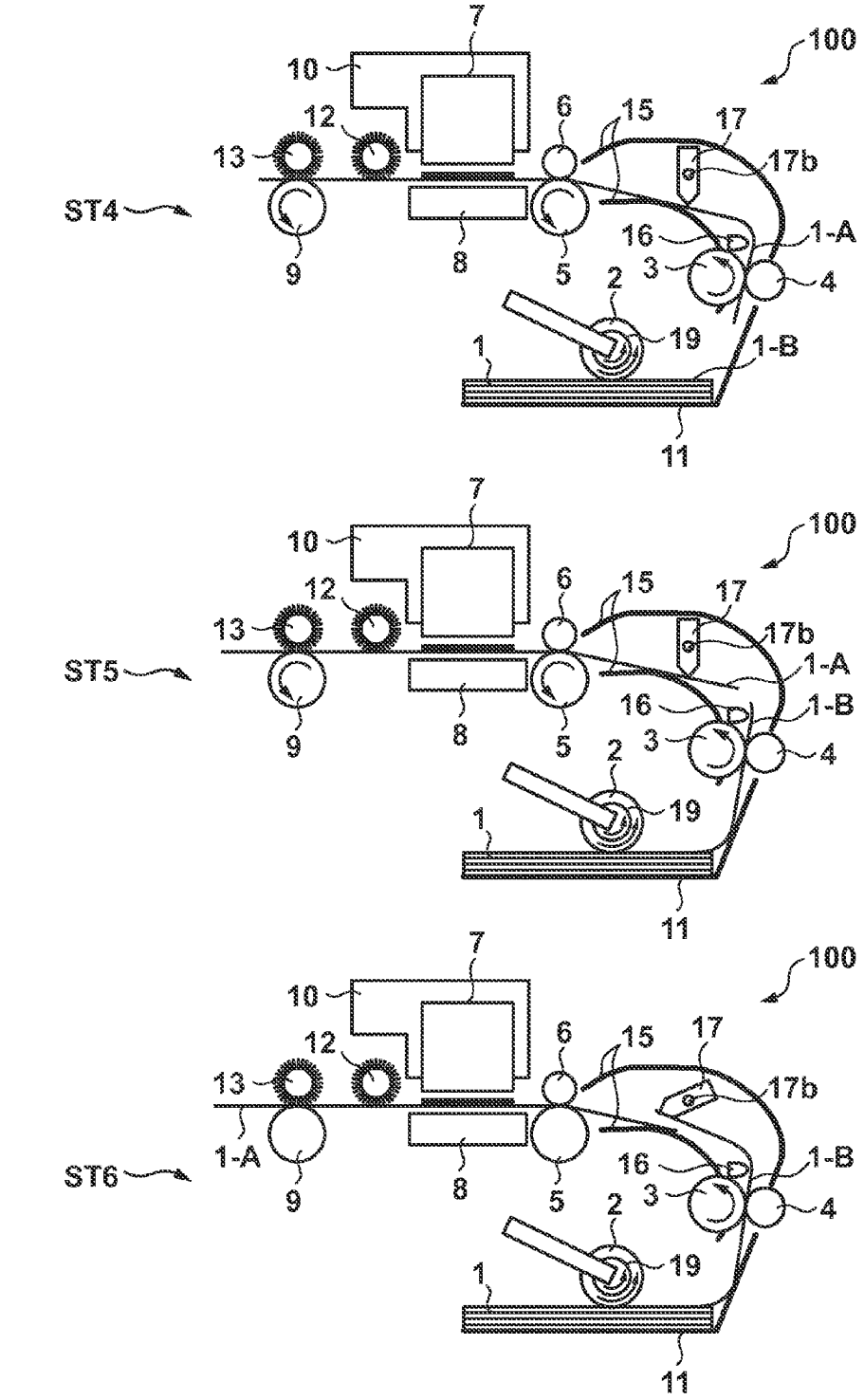
FIG. 2 is a view for explaining the operation of the printing apparatus shown in FIG. 1.
Figure 3:
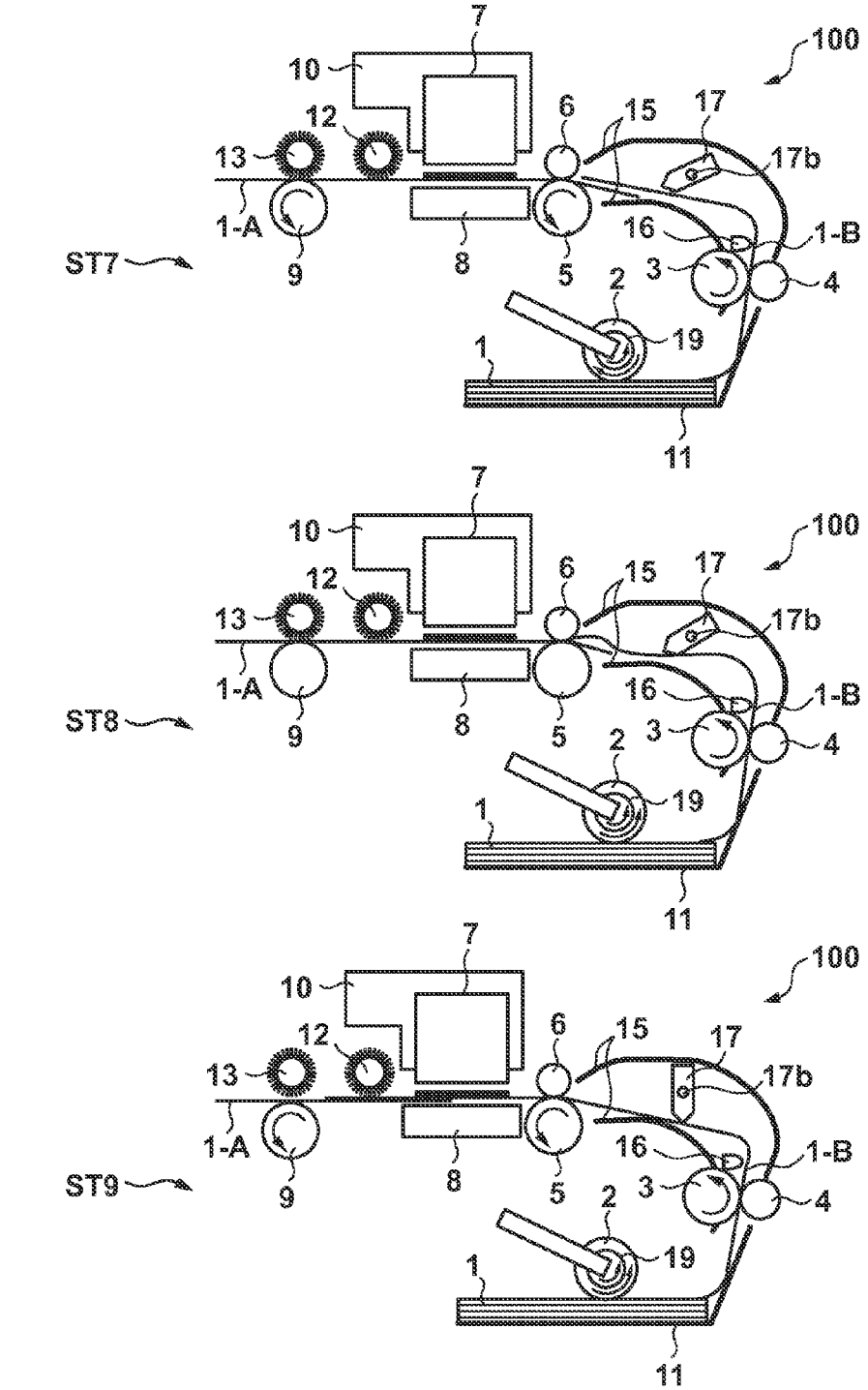
FIG. 3 is a view for explaining the operation of the printing apparatus shown in FIG. 1.

FIGS. 1 to 3 are views for explaining the operation of a printing apparatus 100 according to the embodiment of the present invention, especially, a successive overlapped conveyance operation. FIGS. 1 to 3 schematically show the sectional structure of the printing apparatus 100. In this embodiment, a case in which the present invention is applied to a serial type inkjet printing apparatus will be described. However, the present invention is also applicable to printing apparatuses of other forms.

Note that the term "printing" not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans. Also, sheet-like paper is assumed as a "printing medium" in this embodiment, but cloth, plastic film, and the like may be used as printing media. A sheet-like printing medium will be referred to as a printing sheet hereinafter.

Prior to a description of the operation of the printing apparatus 100, the arrangement of the printing apparatus 100 will be described with reference to a state ST1 of FIG. 1. The printing apparatus 100 includes a feeding tray 11 (a stacking unit) on which a plurality of printing sheets 1 can be stacked, a printing unit for printing on the printing sheet 1, and a conveyance apparatus capable of conveying the printing sheet 1 on the feeding tray 11.

The printing unit includes a printhead 7 and a carriage 10. The printhead 7 prints on the printing sheet 1. In this embodiment, the printhead 7 is an inkjet printhead which prints on the printing sheet 1 by discharging ink. A platen 8 which supports the reverse surface of the printing sheet 1 is arranged at a position facing the printhead 7. A carriage 10 incorporates the printhead 7 and moves in a direction intersecting a conveyance direction.

The conveyance apparatus is broadly divided into a feeding mechanism, conveying mechanism, and a discharging mechanism. The feeding mechanism feeds the printing sheet 1 stacked on the feeding tray 11 to the conveying mechanism. The conveying mechanism conveys the fed printing sheet 1 to the discharging mechanism. The discharging mechanism conveys the printing sheet 1 outside the printing apparatus 100. Conveyance of the printing sheet 1 being printed is mainly performed by the conveying mechanism. In this way, the printing sheet 1 is sequentially conveyed by the feeding mechanism, conveying mechanism, and discharging mechanism. The feeding mechanism side will be referred to as the upstream side of the conveyance direction and the discharging mechanism side will be referred to as the downstream side of the conveyance direction.

The feeding mechanism includes a pickup roller 2, a feeding roller 3, and a feeding driven roller 4. The pickup roller 2 abuts against the top printing sheet 1 stacked on the feeding tray 11 to pick it up. The feeding roller 3 feeds the printing sheet 1 picked up by the pickup roller 2 toward the downstream side of the conveyance direction. The feeding driven roller 4 is biased and pressed against the feeding roller 3 by an elastic member (for example, a spring) (not shown) to nip the printing sheet 1 with the feeding roller 3, thereby feeding the printing sheet 1.

Figure 4A:
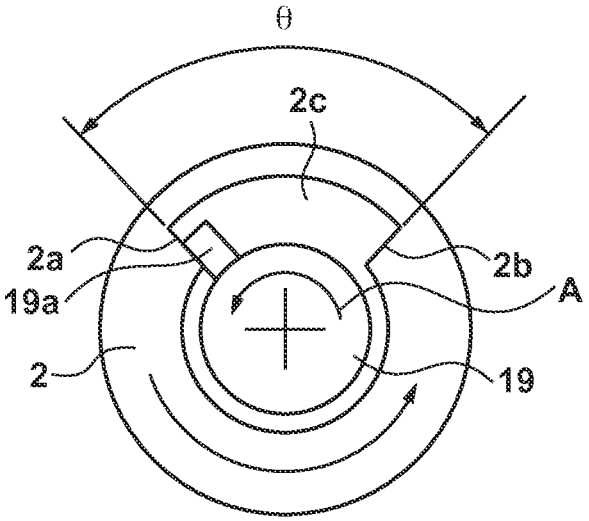
FIGS. 4A and 4B are views for explaining a pickup roller.
Figure 4B:
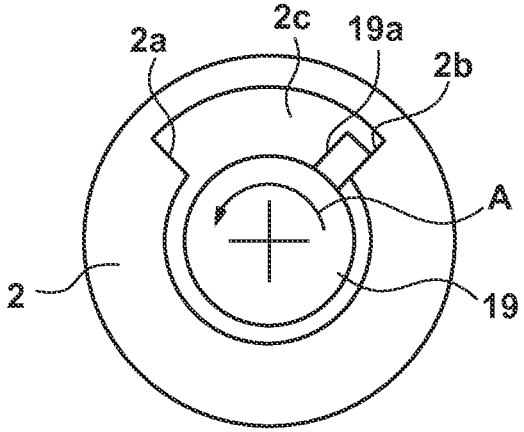

FIGS. 4A and 4B are views for explaining the arrangement of the pickup roller 2. A driving shaft 19 is provided in the pickup roller 2. The driving shaft 19 transmits the driving force of a feeding motor (to be described later) to the pickup roller 2. When picking up the printing sheet 1, the driving shaft 19 and the pickup roller 2 rotate in a direction indicated by an arrow A in FIGS. 4A and 4B. A projection 19*a* is formed in the driving shaft 19. A concave portion 2*c* in which the projection 19*a* fits is formed in the pickup roller 2.

As shown in FIG. 4A, when the projection 19*a* abuts against a first surface 2*a* of the concave portion 2*c* of the pickup roller 2, driving of the driving shaft 19 is transmitted to the pickup roller 2. In this case, when the driving shaft 19 is driven, the pickup roller 2 is also rotated. On the other hand, as shown in FIG. 4B, when the projection 19*a* abuts against a second surface 2*b* of the concave portion 2*c* of the pickup roller 2, driving of the driving shaft 19 is not transmitted to the pickup roller 2. In this case, even if the driving shaft 19 is driven, the pickup roller 2 is not rotated. Also, when the projection 19*a* is formed between the first surface 2*a* and the second surface 2*b* without abutting against the first surface 2*a* or the second surface 2*b*, even if the driving shaft 19 is driven, the pickup roller 2 is not rotated. Although a description will be provided later, when successively feeding the plurality of printing sheets 1 by this mechanism, it is possible to ensure a given gap between the printing sheets 1.

Referring back to FIG. 1, the conveying mechanism includes a conveyance roller 5 and a pinch roller 6. These rollers form a pair of rollers for nipping and conveying the printing sheet 1. The conveyance roller 5 conveys the printing sheet 1 fed by the feeding roller 3 and feeding driven roller 4 to the position facing the printhead 7. The pinch roller 6 is biased and pressed against the conveyance roller 5 by an elastic member (for example, a spring) (not shown) to nip the printing sheet 1 with the conveyance roller 5, thereby conveying the printing sheet 1. In printing, for example, an image is printed on the printing sheet 1 by alternately repeating an operation of conveying the printing sheet 1 by a predetermined amount by the conveyance roller 5 and pinch roller 6, and an operation of moving the carriage 10 and discharging ink by the printhead 7.

A conveyance guide 15 for guiding conveyance of the printing sheet 1 is provided in a conveyance section between a nip portion (to be referred to as a feeding nip portion hereinafter) formed by the feeding roller 3 and feeding driven roller 4 and a nip portion (to be referred to as a conveyance nip portion hereinafter) formed by the conveyance roller 5 and pinch roller 6.

The discharging mechanism includes a discharge roller 9 and spurs 12 and 13. The discharge roller 9 discharges the printing sheet 1 printed by the printhead 7 to the outside of the apparatus. The spurs 12 and 13 rotate while they are in contact with the printing surface of the printing sheet 1 printed by the printhead 7. The spur 13 on the downstream side is biased and pressed against the discharge roller 9 by an elastic member (for example, a spring) (not shown). The spur 12 on the upstream side is arranged on the downstream side of the printhead 7, and no discharge roller 9 is arranged at a position facing the spur 12. The spur 12 is used to prevent the floating of the printing sheet 1, and is also referred to as a pressing spur.

The printing apparatus 100 includes a sheet detection sensor 16. The sheet detection sensor 16 detects the leading edge and trailing edge of the printing sheet 1, and is, for example, an optical sensor. The sheet detection sensor 16 is provided downstream of the feeding roller 3 in the conveyance direction. A sheet pressing lever 17 makes the leading edge of the succeeding printing sheet 1 (to be referred to as the succeeding printing medium or succeeding sheet hereinafter) overlap the trailing edge of the preceding printing sheet 1 (to be referred to as the preceding printing medium or the preceding sheet hereinafter) by pressing the trailing edge. Note that the leading edge and trailing edge of the printing sheet 1 indicate the edge on the downstream side and the edge on the upstream side of the conveyance direction, respectively. The sheet pressing lever 17 is biased by an elastic member (for example, a spring) (not shown) around a rotating shaft 17*b* in a counterclockwise direction in FIG. 1.

Figure 5:
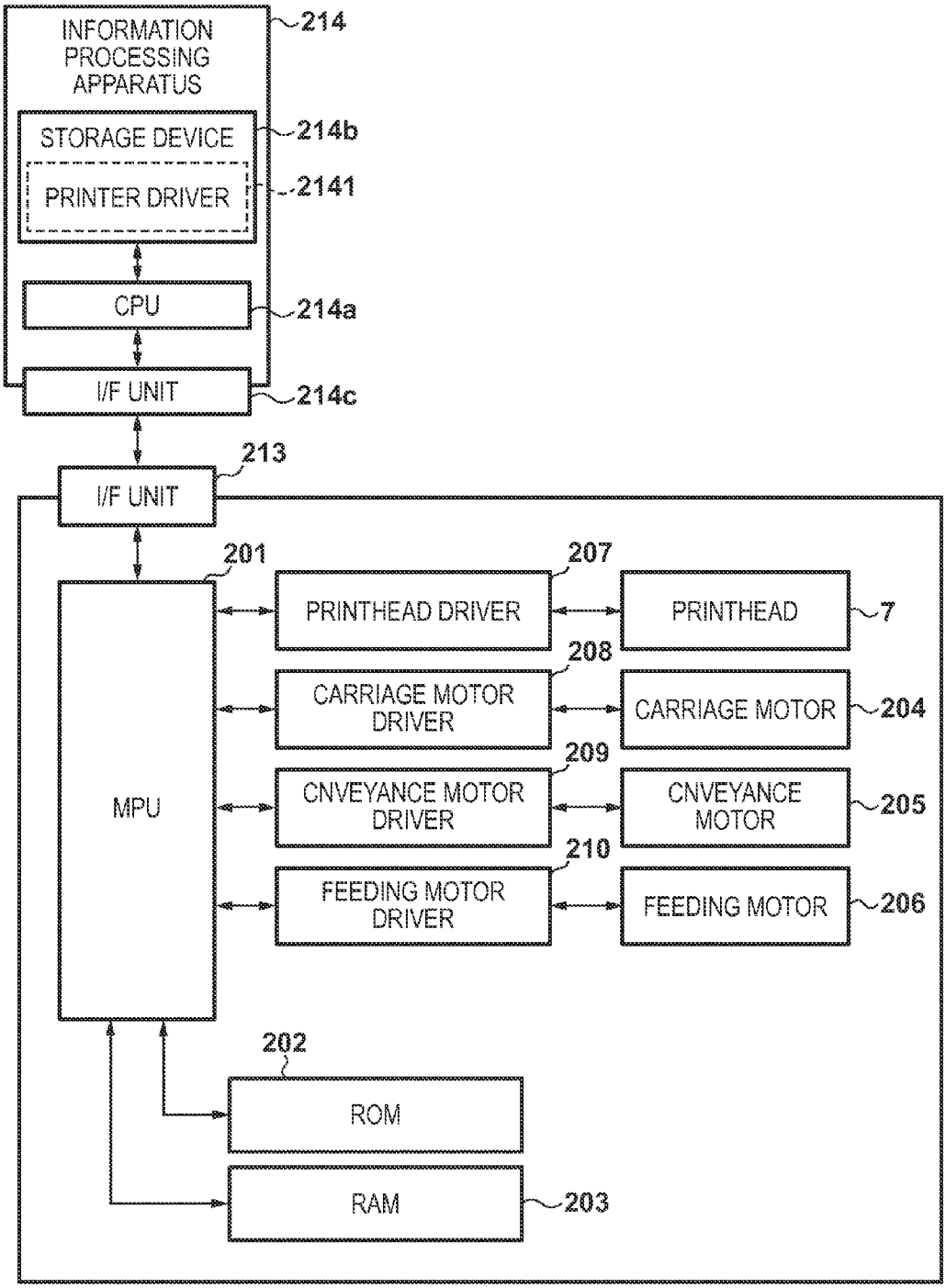
FIG. 5 is a block diagram showing an example of the arrangement of a printing system according to the embodiment of the present invention.

An example of the arrangement of a printing system including the control unit of the printing apparatus 100 and an information processing apparatus 214 capable of transmitting printing data to the printing apparatus 100 will be described with reference to FIG. 5.

The printing apparatus 100 includes an MPU 201. The MPU 201 can control the operation of each component of the printing apparatus 100, and performs data processing and the like. As will be described later, the MPU 201 can control conveyance of the printing sheets 1 so that the trailing edge of the preceding sheet and the leading edge of the succeeding sheet overlap each other. A ROM 202 stores data and programs to be executed by the MPU 201. A RAM 203 temporarily stores processing data to be executed by the MPU 201 and printing data received from the information processing apparatus 214. Note that other storage devices can be used instead of the ROM 202 and RAM 203.

A printhead driver 207 drives the printhead 7. A carriage motor driver 208 drives a carriage motor 204 as the driving source of a driving mechanism for moving the carriage 10. A conveyance motor 205 serves as the driving source of the driving mechanism of the conveyance roller 5 and discharge roller 9. A conveyance motor driver 209 drives the conveyance motor 205.

A feeding motor 206 serves as the driving source of the driving mechanism of the pickup roller 2 and feeding roller 3. A feeding motor driver 210 drives the feeding motor 206.

The MPU 201 controls the printing operation (discharge of ink and movement of the printhead 7) of the printhead 7 via the printhead driver 207 and carriage motor driver 208. The MPU 201 also controls conveyance of the printing sheets 1 via the conveyance motor driver 209 and feeding motor driver 210.

The information processing apparatus 214 is, for example, a personal computer or portable terminal (for example, a smartphone or tablet terminal), and functions as the host computer of the printing apparatus 100. The information processing apparatus 214 includes a CPU 214*a*, a storage device 214*b*, and an I/F unit (interface unit) 214*c*. The CPU 214*a* executes a program stored in the storage device 214*b*. The storage device 214*b* is a RAM, a ROM, a hard disk, or the like, and stores a program to be executed by the CPU 214*a* and various data. The storage device 214*b* stores a printer driver 2141 for controlling the printing apparatus 100. By executing the printer driver 2141, the information processing apparatus 214 can generate printing data. The information processing apparatus 214 and printing apparatus 100 can transmit and receive data via the I/F unit 214*c* and an I/F unit 213.

<Example of Successive Overlapped Conveyance>

A successive overlapped conveyance operation will be described in time series with reference to FIGS. 1 to 3. When the information processing apparatus 214 transmits printing data via the I/F unit 213, the printing data is processed by the MPU 201, and then loaded into the RAM 203. The MPU 201 starts a printing operation based on the loaded data.

A description will be provided with reference to the state ST1 of FIG. 1. First, the feeding motor driver 210 drives the feeding motor 206. This rotates the pickup roller 2. At this stage, the feeding motor 206 is driven to rotate at a relatively low speed. In this example, the pickup roller 2 is exemplarily rotated at 7.6 inches/sec.

When the pickup roller 2 rotates, the top printing sheet (a preceding sheet 1-A) stacked on the feeding tray 11 is picked up. The preceding sheet 1-A picked up by the pickup roller 2 is conveyed by the feeding roller 3 rotating in the same direction as that of the pickup roller 2. The feeding motor 206 also drives the feeding roller 3. This embodiment will be described by using an arrangement including the pickup roller 2 and the feeding roller 3. However, an arrangement including only a feeding roller for feeding the printing sheet stacked on the stacking unit may be adopted.

When the sheet detection sensor 16 provided on the downstream side of the feeding roller 3 detects the leading edge of the preceding sheet 1-A, the feeding motor 206 is driven to rotate at a relatively high speed. In this example, the pickup roller 2 and feeding roller 3 exemplarily rotate at 20 inches/sec.

A description will be provided with reference to a state ST2 of FIG. 1. When the feeding roller 3 is continuously rotated, the leading edge of the preceding sheet 1-A rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion.

A description will be provided with reference to a state ST3 of FIG. 1. Upon end of the skew correction operation of the preceding sheet 1-A, the conveyance motor 205 is driven to start rotation of the conveyance roller 5. The conveyance roller 5 conveys the sheet at, for example, 15 inches/sec. The preceding sheet 1-A is aligned with the position facing the printhead 7. This position is the start position of printing by the printhead 7, and may be referred to as an alignment position. After the alignment operation, a printing operation is performed by discharging ink from the printhead 7 based on the printing data.

Note that the alignment operation is performed by making the leading edge of the printing sheet 1 abut against the conveyance nip portion to temporarily position the printing sheet 1 at the position of the conveyance roller 5, and controlling the rotation amount of the conveyance roller 5 with reference to the position of the conveyance roller 5.

The printing apparatus 100 of this embodiment is a serial type printing apparatus in which the carriage 10 mounts the printhead 7. The printing operation of the printing sheet 1 is performed by repeating a conveyance operation and an image forming operation. The conveyance operation is an operation of intermittently conveying the printing sheet by a predetermined amount using the conveyance roller 5. The image forming operation is an operation of discharging ink from the printhead 7 while moving the carriage 10 incorporating the printhead 7 when the conveyance roller 5 stops.

When alignment of the preceding sheet 1-A is performed, the feeding motor 206 is switched to low-speed driving again. That is, the pickup roller 2 and feeding roller 3 rotate at 7.6 inches/sec. While the conveyance roller 5 intermittently conveys the printing sheet 1 by the predetermined amount, the feeding motor 206 also intermittently drives the feeding roller 3. That is, while the conveyance roller 5 rotates, the feeding roller 3 also rotates. While the conveyance roller 5 stops, the feeding roller 3 also stops. The rotation speed of the feeding roller 3 is lower than that of the conveyance roller 5. Consequently, the printing sheet 1 is stretched between the conveyance roller 5 and the feeding roller 3. The feeding roller 3 is rotated together with the printing sheet 1 conveyed by the conveyance roller 5.

When the feeding motor 206 is intermittently driven, the driving shaft 19 also rotates. As described above, however, the rotation speed of the pickup roller 2 is lower than that of the conveyance roller 5. Consequently, the pickup roller 2 is rotated together with the printing sheet 1 conveyed by the conveyance roller 5. The pickup roller 2 thus rotates ahead of the driving shaft 19. More specifically, the projection 19*a* of the driving shaft 19 is spaced apart from the first surface 2*a* and abuts against the second surface 2*b*. Therefore, the second printing sheet (a succeeding sheet 1-B) is not picked up soon after the trailing edge of the preceding sheet 1-A passes through the pickup roller 2. After the preceding sheet 1-A passes through the feeding nip portion and the driving shaft 19 is driven for a predetermined time, the projection 19*a* abuts against the first surface 2*a*. The rotation of the driving shaft 19 is transmitted to the pickup roller 2, and the pickup roller 2 starts to rotate. This operation generates a time lag until the succeeding sheet 1-B is picked up.

A description will be provided with reference to a state ST4 of FIG. 2. In the state ST4, a state in which the pickup roller 2 starts to rotate, and picks up the succeeding sheet 1-B is shown. Due to a factor such as the responsiveness of the sensor, the sheet detection sensor 16 requires a predetermined interval or more between the successive printing sheets 1 to detect the edges of the printing sheets 1 more correctly. As described above, in this embodiment, with the arrangement including the driving shaft 19 and pickup roller 2, a time lag is generated until the succeeding sheet 1-B is picked up and the interval is ensured.

That is, it is necessary to separate the leading edge of the succeeding sheet 1-B from the trailing edge of the preceding sheet 1-A by a predetermined distance to provide a predetermined time interval from when the sheet detection sensor 16 detects the trailing edge of the preceding sheet 1-A until it detects the leading edge of the succeeding sheet 1-B. To achieve this, the angle of the concave portion 2*c* of the pickup roller 2 is set to about 70°.

A description will be provided with reference to a state ST5 of FIG. 2. The succeeding sheet 1-B picked up by the pickup roller 2 is conveyed by the feeding roller 3. At this time, the preceding sheet 1-A undergoes an image forming operation by the printhead 7 based on the printing data. When the sheet detection sensor 16 detects the leading edge of the succeeding sheet 1-B, the feeding motor 206 is switched to high-speed driving again. That is, the pickup roller 2 and feeding roller 3 rotate at 20 inches/sec.

A description will be provided with reference to a state ST6 of FIG. 2. The sheet pressing lever 17 presses the trailing edge of the preceding sheet 1-A downward, as shown in the state ST5 of FIG. 2. The succeeding sheet 1-B is moved at a speed higher than that at which the preceding sheet 1-A moves downstream by the printing operation. This makes it possible to form a state in which the leading edge of the succeeding sheet 1-B overlaps the trailing edge of the preceding sheet 1-A (the state ST6 of FIG. 2). Since the preceding sheet 1-A undergoes the printing operation based on the printing data, it is intermittently conveyed by the conveyance roller 5. On the other hand, after the sheet detection sensor 16 detects the leading edge of the succeeding sheet 1-B, the succeeding sheet 1-B can catch up with the preceding sheet 1-A by continuously rotating the feeding roller 3 at 20 inches/sec.

A description will be provided with reference to a state ST7 of FIG. 3. After forming an overlap state in which the leading edge of the succeeding sheet 1-B overlaps the trailing edge of the preceding sheet 1-A, the succeeding sheet 1-B is conveyed by the feeding roller 3 until the leading edge of the succeeding sheet 1-B stops at a predetermined position (determination position) upstream of the conveyance nip portion, and then stands by.

The position of the leading edge of the succeeding sheet 1-B is calculated from the rotation amount of the feeding roller 3 after the sheet detection sensor 16 detects the leading edge of the succeeding sheet 1-B, and controlled based on the calculation result. At this time, the preceding sheet 1-A undergoes an image forming operation based on the printing data by the printhead 7.

A description will be provided with reference to a state ST8 of FIG. 3. When the conveyance roller 5 stops to perform the image forming operation of the preceding sheet 1-A (in this example, the conveyance roller 5 stops to perform the image forming operation of the last row), the feeding roller 3 is driven. This makes the leading edge of the printing sheet 1-B abut against the conveyance nip portion, thereby performing the skew correction operation of the succeeding sheet 1-B.

A description will be provided with reference to a state ST9 of FIG. 3. When the image forming operation of the preceding sheet 1-A ends, it is possible to perform alignment of the succeeding sheet 1-B while keeping the state in which the succeeding sheet 1-B overlaps the preceding sheet 1-A by rotating the conveyance roller 5 by a predetermined amount. The printing operation of the succeeding sheet 1-B starts based on the printing data. When the succeeding sheet 1-B is intermittently conveyed for the printing operation, the preceding sheet 1-A is also intermittently conveyed, and is finally discharged outside the printing apparatus by the discharge roller 9.

When alignment of the succeeding sheet 1-B is performed, the feeding motor 206 is switched to low-speed driving again. That is, the pickup roller 2 and feeding roller 3 rotate at 7.6 inches/sec. If there is printing data even after the succeeding sheet 1-B, the process returns to the state ST4 of FIG. 2 to pick up the third printing sheet.

As described above, it is possible to continuously perform a printing operation for the plurality of printing sheets 1 while performing successive overlapped conveyance.

Figure 6B:
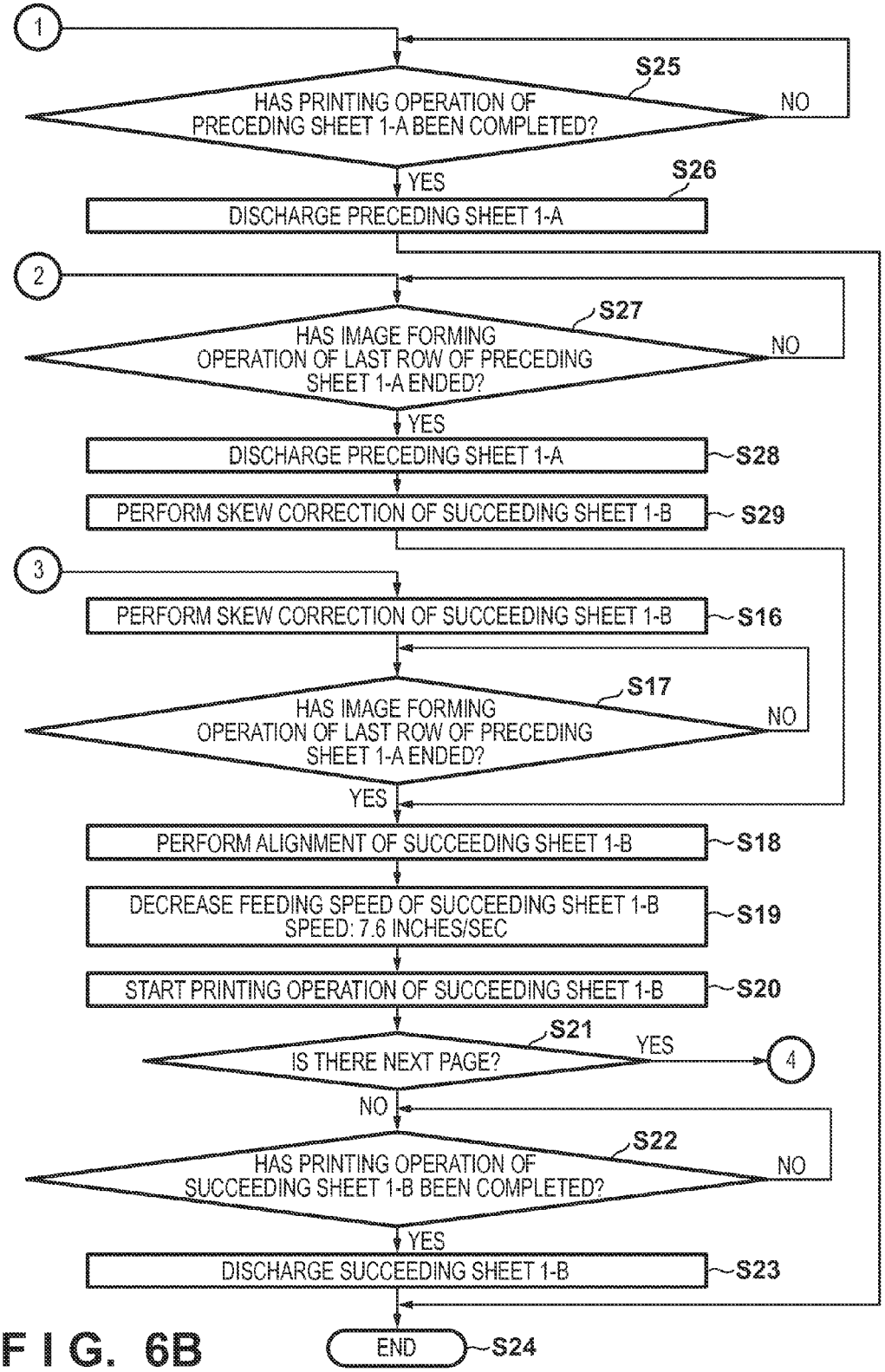

An example of processing by the MPU 201 to execute successive overlapped conveyance described above will be explained. FIGS. 6A and 6B are flowcharts illustrating successive overlapped conveyance processing executed by the MPU 201.

In step S1, when the information processing apparatus 214 transmits a printing start instruction via the I/F unit 213, a printing operation starts. In step S2, the feeding operation of the preceding sheet 1-A starts. More specifically, the feeding motor 206 is driven at low speed. The pickup roller 2 rotates at 7.6 inches/sec. The pickup roller 2 picks up the preceding sheet 1-A, and the feeding roller 3 feeds the preceding sheet 1-A toward the printhead 7.

In step S3, the sheet detection sensor 16 detects the leading edge of the preceding sheet 1-A. When the sheet detection sensor 16 detects the leading edge of the preceding sheet 1-A, the feeding motor 206 is switched to high-speed driving in step S4. That is, the pickup roller 2 and feeding roller 3 rotate at 20 inches/sec. In step S5, by controlling the rotation amount of the feeding roller 3 after the sheet detection sensor 16 detects the leading edge of the preceding sheet 1-A, the leading edge of the preceding sheet 1-A is made to abut against the conveyance nip portion to perform the skew correction operation of the preceding sheet 1-A.

In step S6, alignment of the preceding sheet 1-A is performed based on the printing data. That is, the preceding sheet 1-A is conveyed to a printing start position with reference to the position of the conveyance roller 5 based on the printing data by controlling the rotation amount of the conveyance roller 5. In step S7, the feeding motor 206 is switched to low-speed driving. In step S8, a printing operation starts when the printhead 7 discharges ink to the preceding sheet 1-A.

More specifically, the printing operation of the preceding sheet 1-A is performed by repeating a conveyance operation of intermittently conveying the preceding sheet 1-A by the conveyance roller 5 and an image forming operation (ink discharge operation) of discharging ink from the printhead 7 by moving the carriage 10. The feeding motor 206 is intermittently driven at low speed in synchronization with the operation of intermittently conveying the preceding sheet 1-A by the conveyance roller 5. That is, the pickup roller 2 and feeding roller 3 intermittently rotate at 7.6 inches/sec.

In step S9, it is determined whether there is printing data of the next page. If there is no printing data of the next page, the process advances to step S25. Upon completion of the printing operation of the preceding sheet 1-A in step S25, the preceding sheet 1-A is discharged in step S26, thereby terminating the printing operation.

If there is printing data of the next page, the feeding operation of the succeeding sheet 1-B starts in step S10. More specifically, the pickup roller 2 picks up the succeeding sheet 1-B, and the feeding roller 3 feeds the succeeding sheet 1-B toward the printhead 7. The pickup roller 2 rotates at 7.6 inches/sec. As described above, since the large concave portion 2*c* of the pickup roller 2 is provided with respect to the projection 19*a* of the driving shaft 19, the succeeding sheet 1-B is fed while having a predetermined interval with respect to the trailing edge of the preceding sheet 1-A.

In step S11, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S12. That is, the pickup roller 2 and feeding roller 3 rotate at 20 inches/sec. In step S13, by controlling the rotation amount of the feeding roller 3 after the sheet detection sensor 16 detects the leading edge of the succeeding sheet 1-B, the succeeding sheet 1-B is conveyed so that its leading edge is set at a predetermined position (determination position) a predetermined amount before the conveyance nip portion. The preceding sheet 1-A is intermittently conveyed based on the printing data. Continuously driving the feeding motor 206 at high speed forms the overlap state in which the leading edge of the succeeding sheet 1-B overlaps the trailing edge of the preceding sheet 1-A.

In step S14, it is determined whether predetermined conditions are satisfied. The predetermined conditions are conditions for determining whether to execute successive overlapped conveyance. In this embodiment, skew correction of the succeeding sheet 1-B is performed at a timing according to a determination result, and a detailed description thereof will be provided later.

If the predetermined conditions are satisfied (successive overlapped conveyance is to be executed), it is determined in step S15 whether the image forming operation of the last row of the preceding sheet 1-A has started. If it is determined that the image forming operation of the last row of the preceding sheet 1-A has started, the process advances to step S16; otherwise, the process stands by until the image forming operation starts. In step S16, the leading edge of the succeeding sheet 1-B is made to abut against the conveyance nip portion while keeping the overlap state, thereby performing the skew correction operation of the succeeding sheet 1-B. That is, if it is determined to execute successive overlapped conveyance, the skew correction operation of the succeeding sheet 1-B is performed at the following timing. That is, the skew correction operation is performed when the leading edge of the succeeding sheet 1-B overlaps the trailing edge of the preceding sheet 1-A and the preceding sheet 1-A is nipped by the conveyance nip portion. In addition, at this time, the image forming operation of the last row of the preceding sheet 1-A is in progress.

If it is determined in step S17 that the image forming operation of the last row of the preceding sheet 1-A has ended, the preceding sheet 1-A and the succeeding sheet 1-B are conveyed by successive overlapped conveyance while keeping the overlap state, thereby performing alignment of the succeeding sheet 1-B in step S18. That is, the preceding sheet 1-A and the succeeding sheet 1-B are nipped and conveyed while the overlapping portion between the trailing edge of the preceding sheet 1-A and the leading edge of the succeeding sheet 1-B is nipped by the conveyance nip portion.

If it is determined in step S14 that the predetermined conditions are not satisfied, the overlap state is canceled to perform alignment of the succeeding sheet 1-B. More specifically, if it is determined in step S27 that the image forming operation of the last row of the preceding sheet 1-A has ended, the discharge operation of the preceding sheet 1-A is performed in step S28. The discharge operation of the preceding sheet 1-A is performed until the trailing edge of the preceding sheet 1-A at least passes through the conveyance nip portion. In this embodiment, the preceding sheet 1-A stops before its trailing edge passes through the printhead 7. As a practical example, the discharge operation of the preceding sheet 1-A is performed until the trailing edge of the preceding sheet 1-A is set at a position 5 mm away from the conveyance nip portion on the downstream side of the sheet conveyance direction.

During this operation, the feeding motor 206 is not driven, and thus the succeeding sheet 1-B stops while its leading edge is at the predetermined position (determination position) the predetermined amount before the conveyance nip portion. As a practical example, the succeeding sheet 1-B stops while its leading edge is at a position 8 mm before the conveyance nip portion. The discharge operation of the preceding sheet 1-A cancels the overlap state. In step S29, the leading edge of the succeeding sheet 1-B is made to abut against the conveyance nip portion to perform the skew correction operation of the succeeding sheet 1-B. That is, if it is determined not to execute successive overlapped conveyance, the skew correction operation of the succeeding sheet 1-B is performed while the preceding sheet 1-A passes through the conveyance nip portion and before the trailing edge of the preceding sheet 1-A passes through the printhead 7. In step S18, alignment of the succeeding sheet 1-B is performed. In this way, the preceding sheet and the succeeding sheet are nipped and conveyed without overlapping each other.

In step S19, the feeding motor 206 is switched to low-speed driving. In step S20, a printing operation starts by discharging ink from the printhead 7 to the succeeding sheet 1-B. More specifically, the printing operation of the succeeding sheet 1-B is performed by repeating a conveyance operation of intermittently conveying the succeeding sheet 1-B by the conveyance roller 5 and an image forming operation (ink discharge operation) of discharging ink from the printhead 7 by moving the carriage 10. The feeding motor 206 is intermittently driven at low speed in synchronization with the operation of intermittently conveying the succeeding sheet 1-B by the conveyance roller 5. That is, the pickup roller 2 and feeding roller 3 intermittently rotate at 7.6 inches/sec.

In step S21, it is determined whether there is printing data of the next page. If there is printing data of the next page, the process returns to step S10. If there is no printing data of the next page, when the image forming operation of the succeeding sheet 1-B is complete in step S22, the discharge operation of the succeeding sheet 1-B is performed in step S23 and the printing operation ends in step S24.

Figure 7:
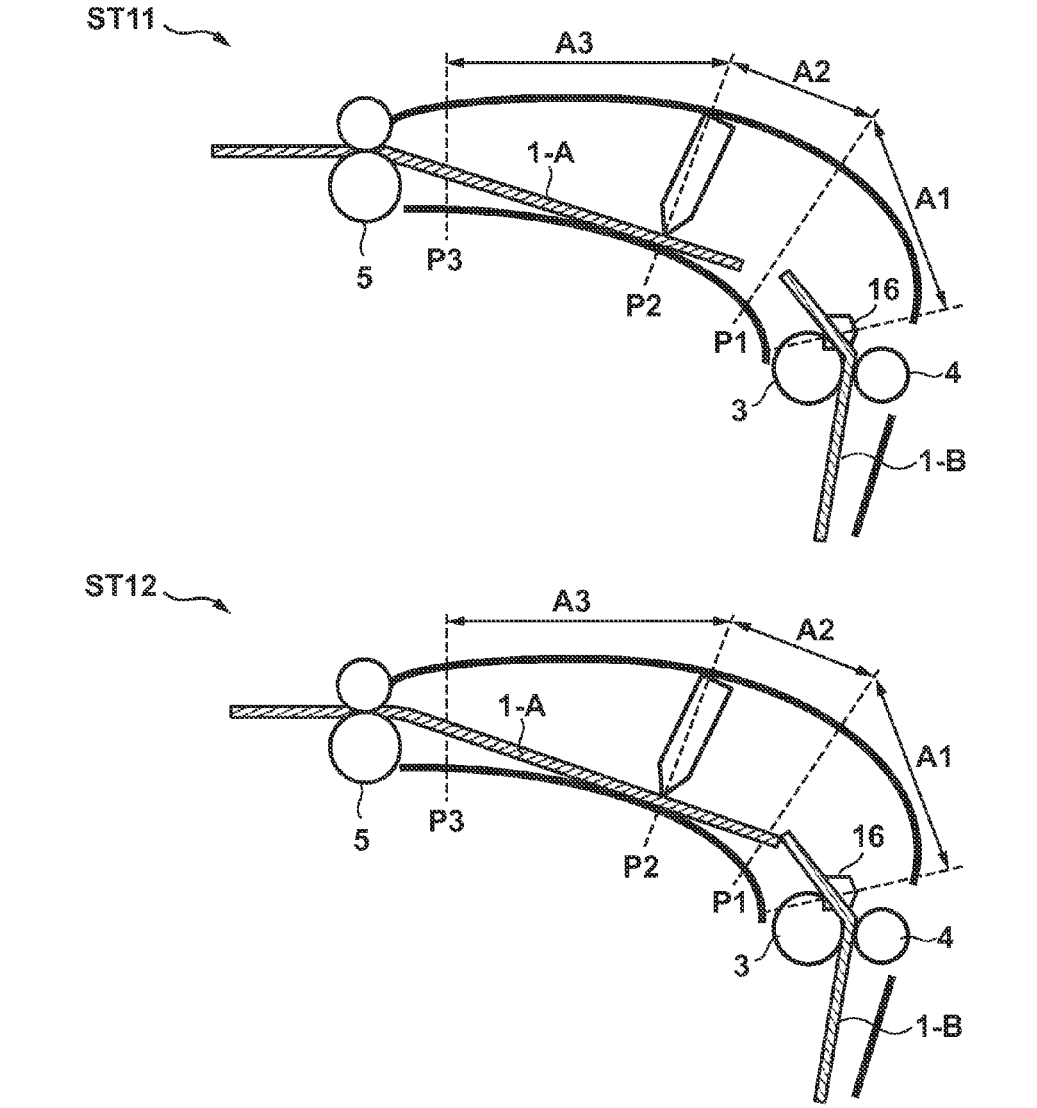
FIG. 7 is a view for explaining an operation of making a succeeding sheet overlap a preceding sheet.
Figure 8:
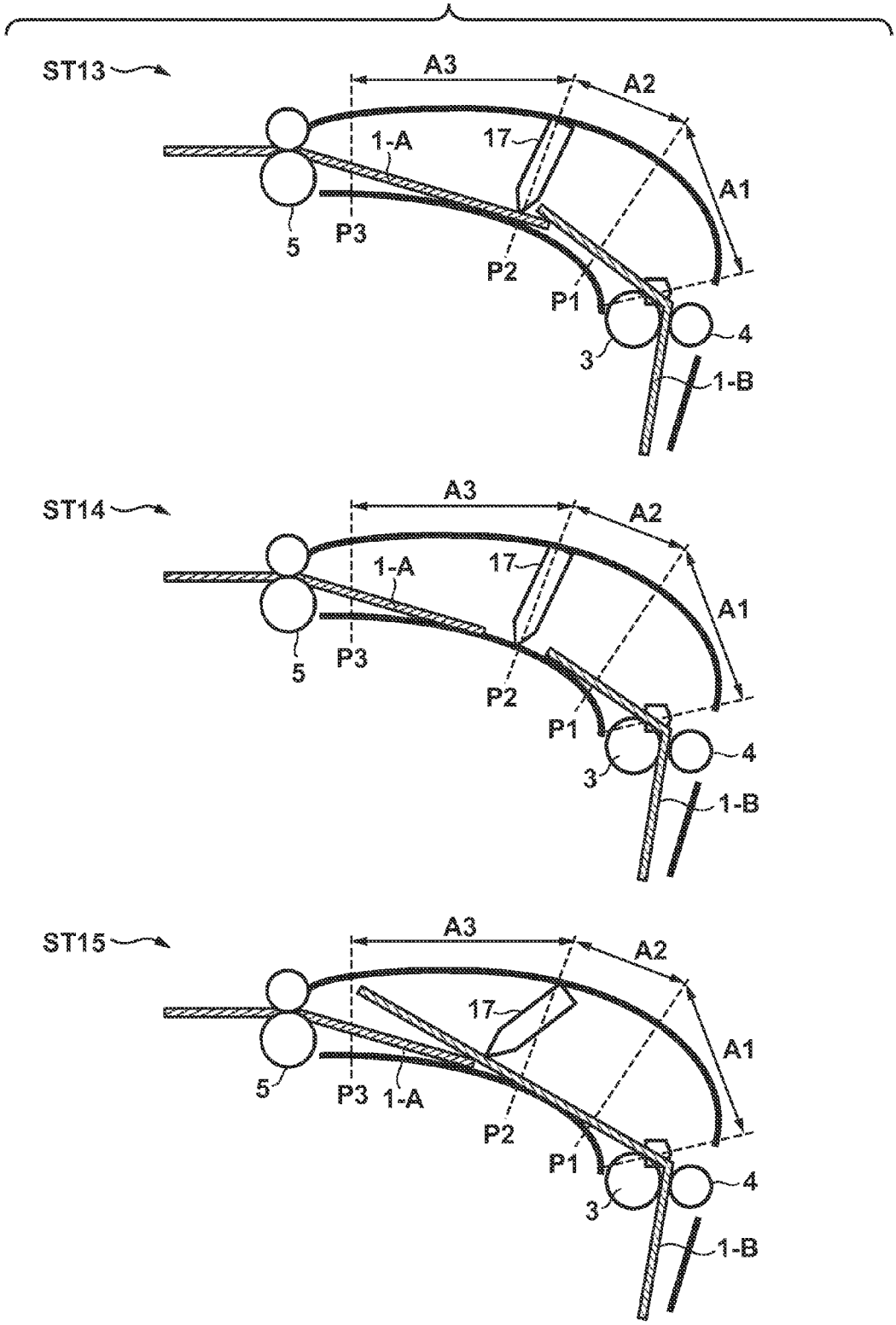
FIG. 8 is a view for explaining the operation of making the succeeding sheet overlap the preceding sheet.

The operation, described in steps S12 and S13 of FIG. 6A, of forming the overlap state in which the leading edge of the succeeding sheet 1-B overlaps the trailing edge of the preceding sheet 1-A will be explained. FIGS. 7 and 8 are views for explaining the operation of making the succeeding sheet 1-B overlap the preceding sheet 1-A according to this embodiment. FIGS. 7 and 8 are enlarged views each showing a portion between the feeding nip portion formed by the feeding roller 3 and feeding driven roller 4 and the conveyance nip portion formed by the conveyance roller 5 and pinch roller 6.

Three states in a process of conveying the printing sheets 1 by the conveyance roller 5 and feeding roller 3 will be sequentially described. The first state in which an operation of making the succeeding sheet 1-B chase the preceding sheet 1-A is performed will be described with reference to states ST11 and ST12 of FIG. 7. The second state in which an operation of making the succeeding sheet 1-B overlap the preceding sheet 1-A is performed will be described with reference to states ST13 and ST14 of FIG. 8. The third state in which it is determined whether to perform the skew correction operation of the succeeding sheet 1-B while keeping the overlap state will be described with reference to a state ST15 of FIG. 8.

In the state ST11 of FIG. 7, the feeding roller 3 is controlled to convey the succeeding sheet 1-B, and the sheet detection sensor 16 detects the leading edge of the succeeding sheet 1-B. A section from the sheet detection sensor 16 to a position P1 at which the succeeding sheet 1-B can be made to overlap the preceding sheet 1-A is defined as a first section A1. In the first section A1, an operation of making the leading edge of the succeeding sheet 1-B chase the trailing edge of the preceding sheet 1-A is performed. The position P1 is decided based on the arrangement of the mechanism.

In the first state, the chasing operation may stop in the first section A1. If, as shown in the state ST12 of FIG. 7, the leading edge of the succeeding sheet 1-B passes the trailing edge of the preceding sheet 1-A before the position P1, the operation of making the succeeding sheet 1-B overlap the preceding sheet 1-A is not performed.

In the state ST13 of FIG. 8, a section from the position P1 to a position P2 at which the sheet pressing lever 17 is provided is defined as a second section A2. In the second section A2, the operation of making the succeeding sheet 1-B overlap the preceding sheet 1-A is performed.

In the second state, the operation of making the succeeding sheet overlap the preceding sheet may stop in the second section A2. If, as shown in the state ST14 of FIG. 8, the leading edge of the succeeding sheet 1-B cannot catch up with the trailing edge of the preceding sheet 1-A within the second section A2, it is impossible to perform the operation of making the succeeding sheet 1-B overlap the preceding sheet 1-A.

In a state ST15 of FIG. 8, a section from the above-described position P2 to a position P3 is defined as a third section A3. The position P3 is the position of the leading edge of the succeeding sheet 1-B when the succeeding sheet 1-B stops in step S13 of FIG. 6A. While the succeeding sheet 1-B overlaps the preceding sheet 1-A, the succeeding sheet 1-B is conveyed until its leading edge reaches the position P3. In the third section A3, it is determined whether to perform alignment of the succeeding sheet 1-B by making it abut against the conveyance nip portion while keeping the overlap state. That is, it is determined whether to perform alignment of the succeeding sheet by executing successive overlapped conveyance and performing a skew correction operation or to perform alignment of the succeeding sheet by canceling the overlap state and performing a skew correction operation without executing successive overlapped conveyance.

Figure 10:
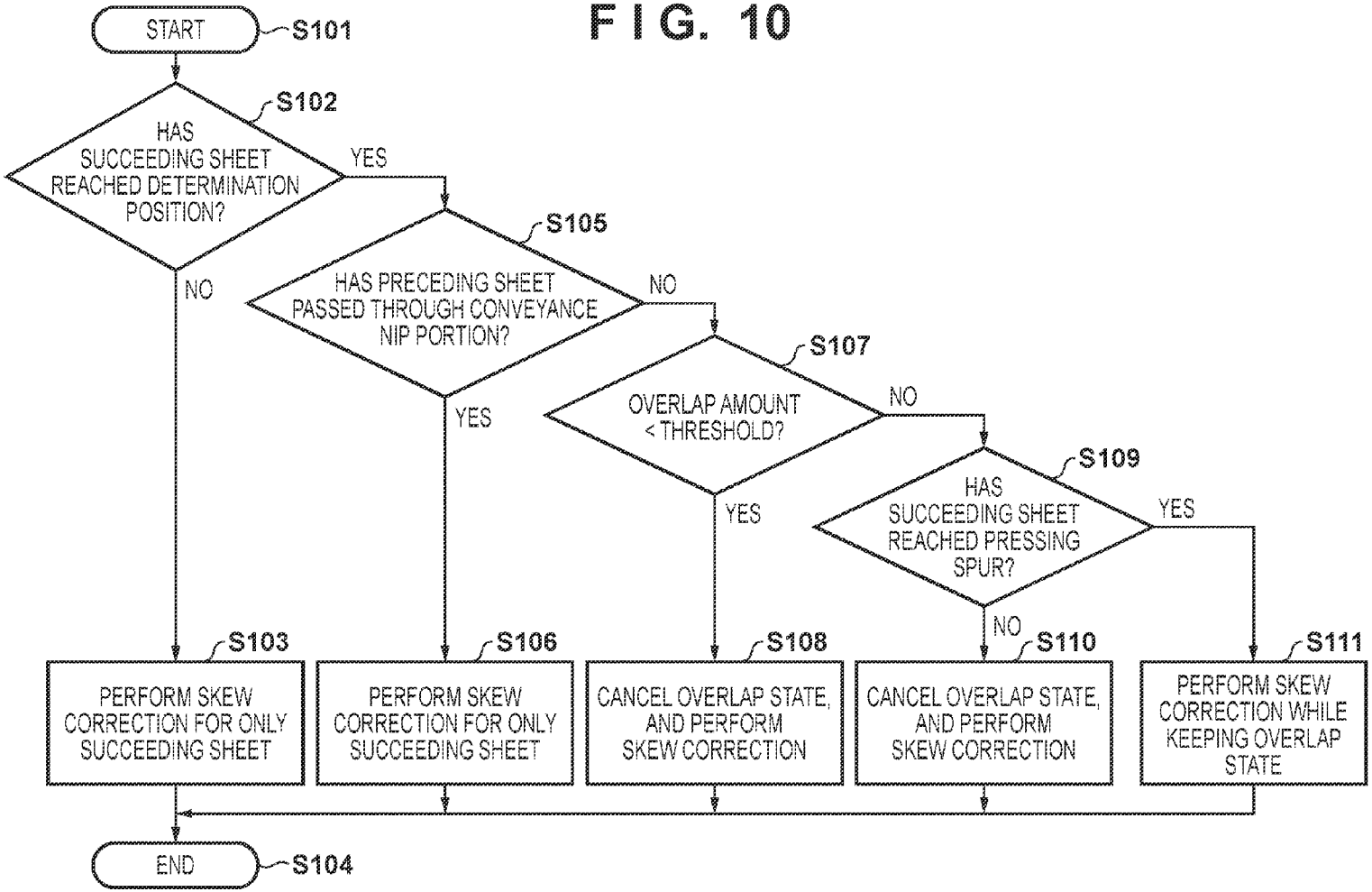
FIG. 10 is a flowchart illustrating an example of processing executed by the control unit of the printing apparatus shown in FIG. 1.

FIG. 10 is a flowchart for explaining the skew correction operation of the succeeding sheet according to this embodiment. The processing of determining whether the predetermined conditions are satisfied, which has been explained in step S14 of FIG. 6A, will be described.

The operation of determining whether to perform the first skew correction operation or to perform the second skew correction operation will be explained. The first skew correction operation is a skew correction operation performed when it is determined to execute successive overlapped conveyance, and is to perform skew correction by making the leading edge of the succeeding sheet 1-B abut against the conveyance nip portion while keeping the overlap state between the preceding sheet 1-A and the succeeding sheet 1-B. The second skew correction operation is a skew correction operation performed when it is determined not to execute successive overlapped conveyance, and is to perform skew correction by canceling the overlap state between the preceding sheet 1-A and the succeeding sheet 1-B and then making the leading edge of the succeeding sheet 1-B abut against the conveyance nip portion.

In step S101, the operation starts. In step S102, it is determined whether the leading edge of the succeeding sheet 1-B has reached the determination position (the position P3 in the state ST15 of FIG. 8). As a practical example, as described above, the determination position is assumed to be a position 8 mm before the conveyance nip portion.

Figure 9:
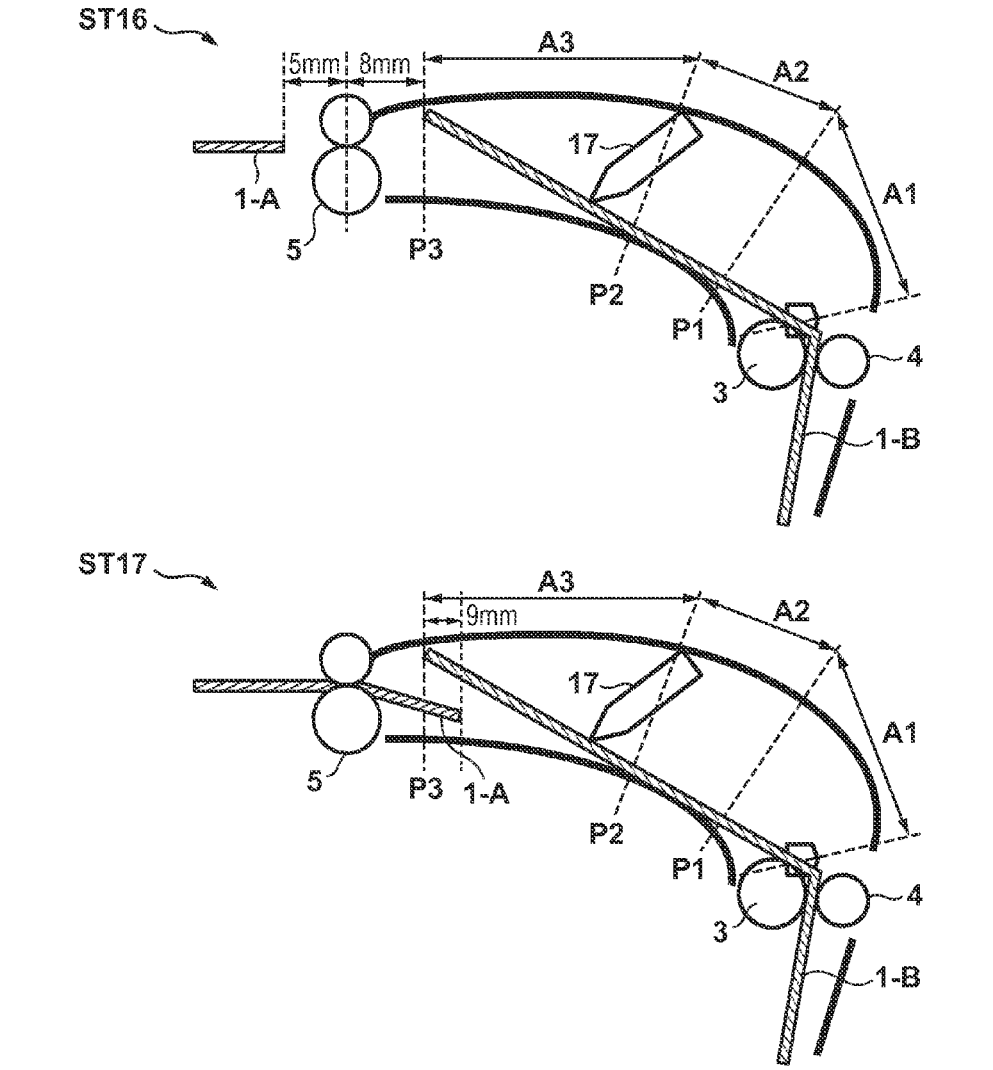
FIG. 9 is a view for explaining an example of the positional relationship between the preceding sheet and the succeeding sheet.

If the leading edge of the succeeding sheet 1-B has not reached the determination position (NO in step S102), it is uncertain whether the leading edge of the succeeding sheet 1-B abuts against the conveyance nip portion by conveying the succeeding sheet 1-B by a predetermined amount. It is thus determined not to execute successive overlapped conveyance, and a skew correction operation for only the succeeding sheet is decided (step S103), thereby terminating the determination operation (step S104). In this case, as exemplified in a state ST16 of FIG. 9, only the preceding sheet 1-A is conveyed until its trailing edge is set at a position 5 mm away from the conveyance nip portion on the downstream side of the sheet conveyance direction, and is stopped. Subsequently, only the succeeding sheet 1-B is made to abut against the conveyance nip portion to perform a skew correction operation. After that, conveyance for alignment of the succeeding sheet 1-B and conveyance of the preceding sheet 1-A by the same amount are simultaneously performed.

On the other hand, if it is determined that the leading edge of the succeeding sheet 1-B has reached the determination position P3 (YES in step S102), it is then determined whether the trailing edge of the preceding sheet 1-A has passed through the conveyance nip portion (step S105). If it is determined that the trailing edge of the preceding sheet 1-A has passed through the conveyance nip portion (YES in step pS105), the succeeding sheet does not overlap the preceding sheet. Thus, a skew correction operation for only the succeeding sheet 1-B is decided (step S106). That is, only the succeeding sheet 1-B is made to abut against the conveyance nip portion to perform a skew correction operation, and then alignment of only the succeeding sheet 1-B is performed.

On the other hand, if it is determined that the trailing edge of the preceding sheet 1-A has not passed through the conveyance nip portion (NO in step S105), it is then determined whether the overlap amount of the trailing edge of the preceding sheet 1-A and the leading edge of the succeeding sheet 1-B is smaller than a threshold (step S107). The threshold can be set to 9 mm, as exemplified in a state ST17 of FIG. 9.

The position of the trailing edge of the preceding sheet 1-A is updated along with the printing operation of the preceding sheet 1-A. The position of the leading edge of the succeeding sheet 1-B is at the above-described determination position. That is, the overlap amount decreases along with the printing operation of the preceding sheet 1-A. In this embodiment, therefore, it is determined in step S107 whether the overlap amount at the time of printing the last row of the preceding sheet 1-A is smaller than the threshold.

If it is determined that the overlap amount is smaller than the threshold (YES in step S107), it is determined not to execute successive overlapped conveyance, the overlap state is canceled, and a skew correction operation for only the succeeding sheet 1-B is decided (step S108). That is, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A to the position exemplified in the state ST16 of FIG. 9. However, the feeding roller 3 is not driven. Therefore, the overlap state is canceled. Furthermore, only the succeeding sheet 1-B is made to abut against the conveyance nip portion to perform a skew correction operation. After that, conveyance for alignment of the succeeding sheet 1-B and conveyance of the preceding sheet 1-A by the same amount are simultaneously performed.

If it is determined that the overlap amount is equal to or larger than the threshold (NO in step S107), it is then determined whether to execute successive overlapped conveyance, based on the position of the succeeding sheet 1-B when the printhead 7 starts printing on the succeeding sheet 1-B. In this example, the position of the succeeding sheet 1-B with respect to the pressing spur 12 is exemplarily set as a reference. That is, it is determined whether the succeeding sheet 1-B reaches the pressing spur 12 when alignment of the succeeding sheet 1-B is performed (when the printhead 7 starts printing on the succeeding sheet 1-B) (step S109). Note that a method of calculating the position of the succeeding sheet 1-B will be described later with reference to FIGS. 11 and 12.

If it is determined that the succeeding sheet 1-B does not reach the pressing spur 12 (NO in step S109), it is then determined not to execute successive overlapped conveyance, the overlap state is canceled, and a skew correction operation for only the succeeding sheet is decided (step S110). When the succeeding sheet 1-B does not reach the pressing spur 12, it is determined not to execute successive overlapped conveyance by considering that the succeeding sheet 1-B may float. As a result, after the image forming operation of the preceding sheet 1-A ends, the succeeding sheet 1-B is not conveyed together with the preceding sheet 1-A. More specifically, the conveyance motor 205 drives the conveyance roller 5 to convey the preceding sheet 1-A until its trailing edge is set at a position away from the conveyance nip portion (exemplarily, a position 5 mm away from the conveyance nip portion) on the downstream side of the sheet conveyance direction. However, the feeding roller 3 is not driven. Consequently, the overlap state is canceled. Furthermore, only the succeeding sheet 1-B is made to abut against the conveyance nip portion to perform a skew correction operation. After that, conveyance for alignment of the succeeding sheet 1-B and conveyance of the preceding sheet 1-A by the same amount are simultaneously performed.

If it is determined that the succeeding sheet 1-B reaches the pressing spur 12 (YES in step S109), it is then determined to execute successive overlapped conveyance, and it is decided to perform the skew correction operation of the succeeding sheet 1-B while keeping the overlap state (step S111). That is, the succeeding sheet 1-B is made to abut against the conveyance nip portion while the succeeding sheet 1-B overlaps the preceding sheet 1-A. More specifically, only the feeding roller 3 is rotated by driving only the feeding motor 206 while the conveyance roller 5 stops without driving the conveyance motor 205, thereby performing the skew correction operation of the succeeding sheet 1-B. After the skew correction operation, alignment of the succeeding sheet 1-B is performed while the succeeding sheet 1-B overlaps the preceding sheet 1-A.

As described above, it is determined whether to execute successive overlapped conveyance, based on the position of the succeeding sheet 1-B when the printhead 7 starts printing on the succeeding sheet 1-B. In this embodiment, the position of the succeeding sheet 1-B with respect to the pressing spur 12 is exemplarily set as a reference. However, the position of the succeeding sheet 1-B with respect to one of various components which influence the quality of an image to be printed on the succeeding sheet 1-B and the like, instead of the pressing spur 12, can be set as a reference.

As described above, it can be determined whether to keep or cancel the overlap state between the preceding sheet 1-A and the succeeding sheet 1-B (whether to execute successive overlapped conveyance).

Figure 11:
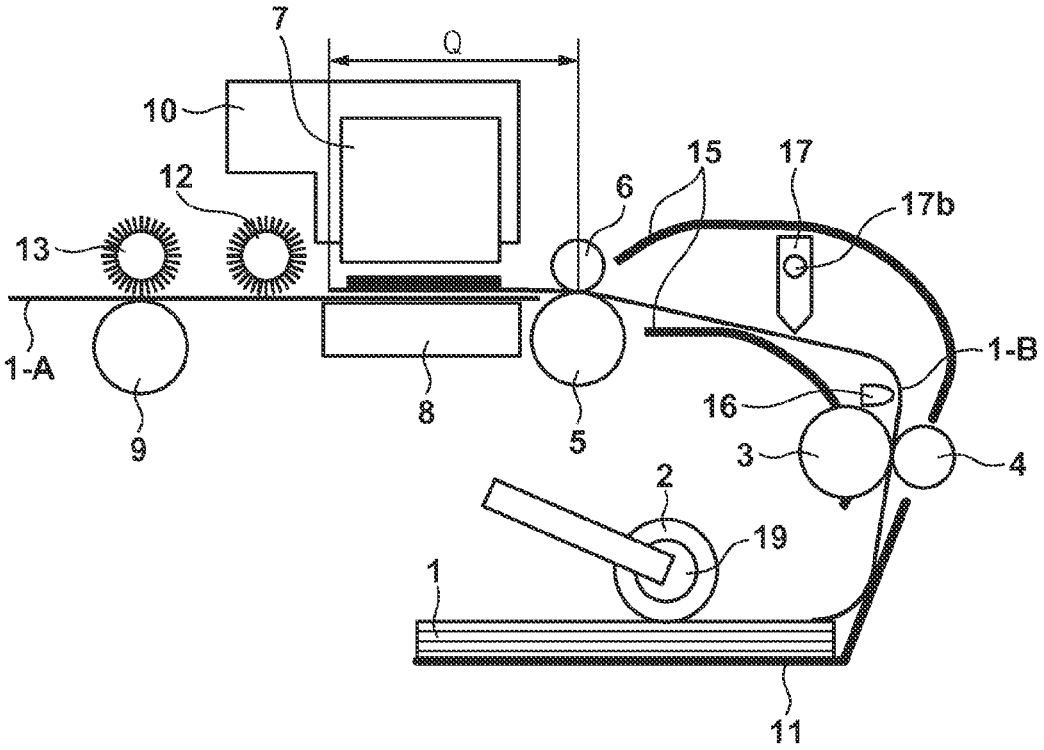
FIG. 11 is a view for explaining a length Q.

An example of calculation of the position of the succeeding sheet 1-B will be described with reference to FIGS. 11 and 12. A case will be exemplified in which a length Q between the conveyance nip portion and the leading edge of the succeeding sheet 1-B when the printhead 7 starts printing on the succeeding sheet 1-B is calculated, as shown in FIG. 11. The length Q defines the position of the leading edge of the succeeding sheet 1-B. Since the distance between the conveyance nip portion and the pressing spur 12 is known in design terms, it is possible to determine whether the succeeding sheet 1-B has reached the pressing spur 12 by comparing the distance with the length Q.

Figure 12:
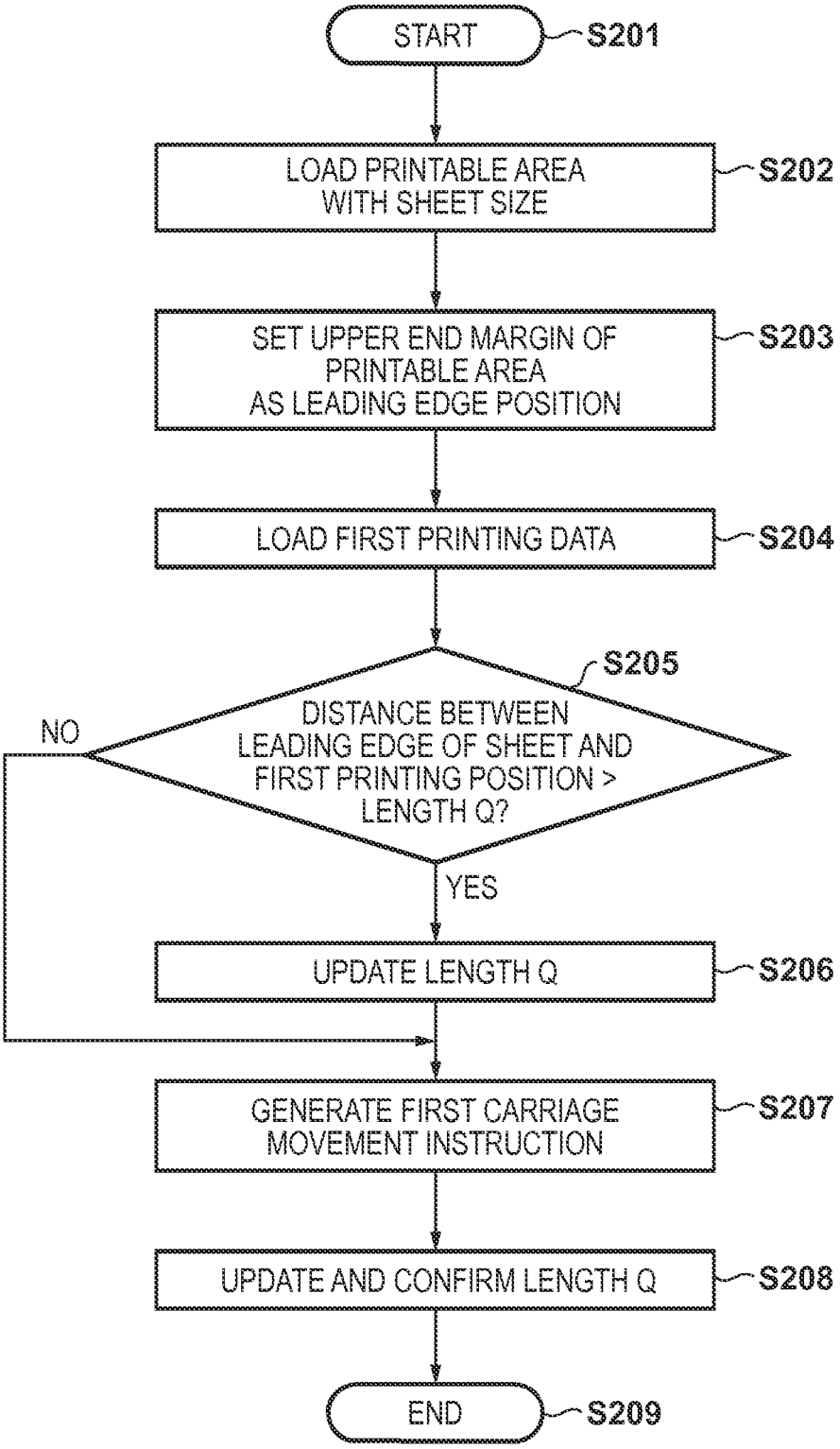
FIG. 12 is a flowchart illustrating an example of processing of calculating the length Q.

FIG. 12 is a flowchart illustrating an example of processing of calculating the length Q. In step S201, the process starts. In step S202, information about a printable area corresponding to the sheet size of the succeeding sheet 1-B is loaded. The printable area information can be stored in, for example, the ROM 202. Based on the printable area information, the uppermost printable position, that is, the upper end margin is specified. The upper end margin is temporarily set as the length Q (step S203)

The first printing data to be printed on the succeeding sheet 1-B is loaded (step S204). Here, first printing data means the first printing data to require an ink discharge operation. That is, the first printing data includes no blank. With this processing, the position of the first printing data from the leading edge of the sheet is specified. In other words, a non-printing area is specified. It is determined whether the distance between the leading edge of the succeeding sheet 1-B and the first printing data is larger than the previously, temporarily set length Q (step S205). If the distance is larger than the length Q, the process advances to step S206; otherwise, the process advances to step S207. In step S206, the length Q is updated by the distance between the leading edge of the succeeding sheet 1-B and the first printing data.

Next, the first carriage movement instruction is generated (step S207). Generating a carriage movement instruction decides a nozzle to be used to print the first printing data. In step S208, the length Q is updated, as needed, and is confirmed so that the position of the decided nozzle coincides with the printing start position of the succeeding sheet 1-B (step S208). The confirmed value of the length Q is saved in, for example, the RAM 203, thereby terminating the process (step S209).

Note that the step of calculating the leading edge position after alignment of the succeeding sheet corresponds to step S9 of the flowchart illustrating the successive overlapped conveyance operation shown in FIG. 6A, and can start immediately after it is confirmed that there is the printing data of the next page.

As described above, according to this embodiment, since skew correction of the succeeding sheet 1-B is executed at the timing according to a result of determining whether to execute successive overlapped conveyance, it is possible to execute successive overlapped conveyance and skew correction in synchronism with each other.

According to this embodiment, at the start of feeding of the succeeding sheet 1-B, it is not necessary to confirm whether to execute successive overlapped conveyance. This is advantageous in that even if the amount of margin of the succeeding sheet 1-B is uncertain at the start of feeding of the succeeding sheet 1-B, it is possible to execute successive overlapped conveyance when the amount of margin is confirmed. In this case, determination of whether to execute successive overlapped conveyance is late. For example, such determination is performed immediately before the conveyance roller 5 conveys the succeeding sheet 1-B. However, the timing of skew correction is switched according to the determination result, and thus it is possible to avoid erroneous conveyance.

Furthermore, according to this embodiment, the synchronous and asynchronous operations of the feeding motor 206 and the conveyance motor 205 are switched when performing the printing operation of the preceding sheet 1-A by the printhead 7. More specifically, before the sheet detection sensor 16 detects the leading edge of the succeeding sheet 1-B, the feeding motor 206 is driven in synchronism with the conveyance motor 205. On the other hand, after the sheet detection sensor 16 detects the leading edge of the succeeding sheet, the feeding motor 206 is continuously driven. Continuously driving the feeding motor makes it possible to perform a chasing operation to make the succeeding sheet 1-B overlap the preceding sheet 1-A, and to adjust the overlap amount of the preceding and succeeding sheets 1 in successive overlapped conveyance. The overlap amount is set by referring to the printing data of the preceding sheet 1-A and that of the succeeding sheet 1-B.

Note that in this embodiment, the preceding sheet 1-A and the succeeding sheet 1-B are fed while having an interval therebetween. An arrangement of conveying the sheets while they overlap each other at the time of feeding can be adopted.

This embodiment assumes that the succeeding sheet 1-B is made to overlap the preceding sheet 1-A so that the succeeding sheet 1-B is set at a position on the side of the printhead 7 at the time of successive overlapped conveyance, but the positions of the sheets may be reversed. That is, the preceding sheet 1-A may be made to overlap the succeeding sheet 1-B so that the preceding sheet 1-A is set at a position on the side of the printhead 7.

This embodiment has exemplified a position 5 mm away from the conveyance nip portion on the downstream side of the sheet conveyance direction as a position at which the trailing edge of the preceding sheet 1-A at least passes through the conveyance nip portion. The present invention is not limited to this, as a matter of course, and this value can be set in consideration of the error between the actual trailing edge position of the preceding sheet 1-A and the controlled and estimated trailing edge position of the preceding sheet. Also, 9 mm has been exemplified as the threshold of the overlap amount of the trailing edge of the preceding sheet 1-A and the leading edge of the succeeding sheet 1-B. The present invention is not limited to this, as a matter of course, and this value can be set in consideration of the error between the actual overlap amount and a controlled and estimated overlap amount.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2014-116206, filed Jun. 4, 2014, which is hereby incorporated by reference herein in its entirety.

What is claimed is:

1. A printing apparatus comprising:

a feeding roller configured to feed a printing sheet;

a conveyance roller configured to convey the printing sheet fed by said feeding roller;

a printing unit configured to print on the printing sheet conveyed by the conveyance roller;

a conveyance control unit configured to control conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller;

a determination unit configured to determine whether to convey the succeeding sheet to a position facing the printing unit while keeping the overlap state or to convey the succeeding sheet to the position after the overlap state has been cancelled; and a skew correction control unit configured to execute a skew correction operation in which a leading edge of the printing sheet abuts against the conveyance roller, wherein the skew correction control unit changes a timing when the skew correction operation for the succeeding sheet is executed according to a determination result of the determination unit.

2. The apparatus according to claim 1, wherein the determination unit determines whether to convey the succeeding sheet to the position while keeping the overlap state or to convey the succeeding sheet to the position after the overlap state has been cancelled after feeding the succeeding printing medium to a predetermined position before the conveyance roller, if it is determined to convey the succeeding sheet to the position while keeping the overlap state, the skew correction control unit executes the skew correction operation for the succeeding sheet at a timing when the conveyance roller conveys the sheet, and if it is determined to convey the succeeding sheet to the position after the overlap state has been cancelled, the skew correction control unit executes the skew correction operation for the succeeding sheet at a timing when the preceding sheet is passing through the conveyance roller.

3. The apparatus according to claim 2, wherein if it is determined to convey the succeeding sheet to the position after the overlap state has been cancelled, the skew correction control unit executes the skew correction operation for the succeeding sheet at a timing after the trailing edge of the preceding sheet passes through the conveyance roller and before the trailing edge of the preceding sheet passes through the printing unit.

4. The apparatus according to claim 1, wherein based on an overlap amount of the trailing edge of the preceding sheet and the leading edge of the succeeding sheet at a time of printing a last row of the preceding sheet, the determination unit determines whether to convey the succeeding sheet to the position while keeping the overlap state or to convey the succeeding sheet to the position after the overlap state has been cancelled.

5. The apparatus according to claim 1, wherein based on a position of the succeeding sheet when the printing unit starts printing on the succeeding sheet, the determination unit determines whether to convey the succeeding sheet to the position while keeping the overlap state or to convey the succeeding sheet to the position after the overlap state has been cancelled.

6. The apparatus according to claim 1, further comprising:

a pressing spur arranged on a downstream side of the printing unit in a conveyance direction of the printing sheet, wherein based on whether the succeeding sheet has reached the pressing spur when the printing unit starts printing on the succeeding sheet, the determination unit determines whether to convey the succeeding sheet to the position while keeping the overlap state or to convey the succeeding sheet to the position after the overlap state has been cancelled.

7. The apparatus according to claim 2, wherein if the preceding sheet is passing through the conveyance roller, the determination unit determines to convey the succeeding sheet to the position after the overlap state has been cancelled.

8. The apparatus according to claim 2, wherein if it is determined to convey the succeeding sheet to the position while keeping the overlap state, the control conveyance unit drives the conveyance roller for conveying the preceding sheet and the succeeding sheet in the overlap state after the skew correction operation for the succeeding sheet is performed, and if it is determined to convey the succeeding sheet to the position after the overlap state has been cancelled, the conveyance control unit stops the conveyance roller, the skew correction operation for the succeeding sheet is executed after the preceding sheet is conveyed by driving the conveyance roller and passes through the conveyance roller, and also the succeeding sheet is conveyed to the printing unit by driving the conveyance roller.

9. A control method for a printing apparatus including a feeding roller configured to feed a printing sheet, a conveyance roller configured to convey the printing sheet fed by the feeding roller, and a printing unit configured to print on the printing sheet conveyed by the conveyance roller, the method comprising:

a control step of controlling conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller;

a determination step of determining whether to convey the succeeding sheet to a position facing the printing unit while keeping the overlap state or to convey the succeeding sheet to the position after the overlap state has been cancelled; and a skew correction control step of executing a skew correction operation in which a leading edge of the printing sheet abuts against the conveyance roller, wherein in the skew correction control step, a timing when the skew correction operation for the succeeding sheet is executed is changed according to a determination result of the determination step.

10. A non-transitory computer-readable storage medium storing a program for causing a computer to execute each step of a control method for a printing apparatus including a feeding roller configured to feed a printing sheet, a conveyance roller configured to convey the printing sheet fed by the feeding roller, and a printing unit configured to print on the printing sheet conveyed by the conveyance roller, the method comprising:

a control step of controlling conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller;

a determination step of determining whether to convey the succeeding sheet to a position facing the printing unit while keeping the overlap state or to convey the succeeding sheet to the position after the overlap state has been cancelled; and a skew correction control step of performing a skew correction operation in which a leading edge of the printing sheet abuts against the conveyance roller, wherein in the skew correction control step, a timing when the skew correction operation for the succeeding sheet is executed is changed according to a determination result of the determination step.

11. The apparatus according to claim 1, wherein if the determination unit determines to convey the succeeding sheet to the position while keeping the overlap state, the skew correction control unit executes the skew correction operation for the succeeding sheet at a timing before the preceding sheet passes through the conveyance roller.

12. The apparatus according to claim 1, wherein if the determination unit determines to convey the succeeding sheet to the position while keeping the overlap state, the skew correction control unit executes the skew correction operation for the succeeding sheet at a timing when the printing unit prints a last row of the preceding sheet.

13. The apparatus according to claim 1, wherein if the determination unit determines to convey the succeeding sheet to the position after the overlap state has been cancelled, the skew correction control unit executes the skew correction operation for the succeeding sheet at a timing after the preceding sheet passes through the conveyance roller.

14. The apparatus according to claim 13, wherein if the determination unit determines to convey the succeeding sheet to the position after the overlap state has been cancelled, the skew correction control unit executes the skew correction operation for the succeeding sheet at a timing before the trailing edge of the preceding sheet passes through the position.

15. A printing apparatus comprising:

a feeding roller configured to feed a printing sheet;

a conveyance roller configured to convey the printing sheet fed by the feeding roller;

a printing unit configured to print on the printing sheet conveyed by the conveyance roller;

a conveyance control unit configured to control conveyance of printing sheets so that an overlap state, in which a trailing edge of a preceding sheet as a printing sheet precedingly fed by the feeding roller and a leading edge of a succeeding sheet as a printing sheet succeedingly fed by the feeding roller overlap each other, is formed between the feeding roller and the conveyance roller;

a determination unit configured to determine whether to execute a first operation in which the succeeding sheet is conveyed to a position facing the printing unit while keeping the overlap state or to execute a second operation in which the succeeding sheet is conveyed to the position after the overlap state has been cancelled; and a skew correction control unit configured to execute a skew correction operation in which a leading edge of the printing sheet abuts against the conveyance roller, wherein if the determination unit determines to execute the first operation, the skew correction control unit executes the skew correction operation for the succeeding sheet before the trailing edge of the preceding sheet passes through the conveyance roller, and if the determination unit determines to execute the second operation, the skew correction control unit executes the skew correction operation for the succeeding sheet after the trailing edge of the preceding sheet passes through the conveyance roller.

16. The apparatus according to claim 15, wherein if the determination unit determines to execute the first operation, the skew correction control unit executes the skew correction operation for the succeeding sheet while the printing unit prints a last row of the preceding sheet.

17. The apparatus according to claim 15, wherein if the determination unit determines to execute the second operation, the skew correction control unit executes the skew correction operation for the succeeding sheet before the trailing edge of the preceding sheet passes through the position.

18. The apparatus according to claim 15, wherein based on an overlap amount of the trailing edge of the preceding sheet and the leading edge of the succeeding sheet at a time of printing a last row of the preceding sheet, the determination unit determines whether to execute the first operation or to execute the second operation.

19. The apparatus according to claim 15, wherein based on a position of the succeeding sheet when the printing unit starts printing on the succeeding sheet, the determination unit determines whether to execute the first operation or to execute the second operation.

20. The apparatus according to claim 15, further comprising:

a pressing spur arranged on a downstream side of the printing unit in a conveyance direction of the printing sheet, wherein based on whether the succeeding sheet has reached the pressing spur when the printing unit starts printing on the succeeding sheet, the determination unit determines whether to execute the first operation or to execute the second operation.

21. The apparatus according to claim 15, wherein if the preceding sheet is passing through the conveyance roller, the determination unit determines to execute the second operation.

22. The apparatus according to claim 15, wherein if it is determined to execute the first operation, the control conveyance unit drives the conveyance roller for conveying the preceding sheet and the succeeding sheet in the overlap state after the skew correction operation for the succeeding sheet is performed, and if it is determined to execute the second operation, the conveyance control unit stops the conveyance roller, the skew correction operation for the succeeding sheet is executed after the preceding sheet is conveyed by driving the conveyance roller and passes through the conveyance roller, and also the succeeding sheet is conveyed to the printing unit by driving the conveyance roller.

* * * * *